US011006764B2

(12) United States Patent
Hager

(10) Patent No.: US 11,006,764 B2
(45) Date of Patent: May 18, 2021

(54) MATTRESS ARRANGEMENT, SUCH AS A BED, HAVING ADJUSTABLE FIRMNESS

(71) Applicant: Starsprings AB, Herrljunga (SE)

(72) Inventor: Bengt Hager, Skara (SE)

(73) Assignee: Starsprings AB, Herrljunga (SE)

( * ) Notice: Subject to any disclaimer, the term of this patent is extended or adjusted under 35 U.S.C. 154(b) by 459 days.

(21) Appl. No.: 15/974,800

(22) Filed: May 9, 2018

(65) Prior Publication Data

US 2018/0325274 A1 Nov. 15, 2018

(30) Foreign Application Priority Data

May 15, 2017 (EP) ..... 17171021

(51) Int. Cl.
*A47C 27/06* (2006.01)
*A47C 27/05* (2006.01)

(52) U.S. Cl.
CPC ..... *A47C 27/061* (2013.01); *A47C 27/064* (2013.01); *A47C 27/05* (2013.01)

(58) Field of Classification Search
CPC ..... A47C 27/061; A47C 27/064; A47C 27/05
See application file for complete search history.

(56) References Cited

U.S. PATENT DOCUMENTS 3,340,548 A 9/1967 Janapol
3,739,409 A * 6/1973 Johnson ..... A47C 27/144 5/697
4,222,137 A 9/1980 Usami
5,105,488 A 4/1992 Hutchinson et al.
7,048,263 B2 5/2006 Ahlqvist et al.
8,176,589 B2 5/2012 Stjerna et al.
10,334,957 B2 * 7/2019 Edling ..... B60N 2/7011
2006/0253994 A1 11/2006 Spinks et al.
2007/0124865 A1 6/2007 Stjerna
(Continued)

FOREIGN PATENT DOCUMENTS

AU 551300 B2 4/1986
DE 69115549 T2 9/1996
(Continued)

OTHER PUBLICATIONS

European Search Report for European Application No. EP17171021 dated Oct. 25, 2017.

*Primary Examiner* — Eric J Kurilla
(74) *Attorney, Agent, or Firm* — Harness, Dickey & Pierce, P.L.C.

(57) ABSTRACT

A pocket spring mattress arrangement, such as a bed arrangement, having adjustable firmness is disclosed. The mattress arrangement includes a pocket spring mattress having a plurality of pocketed units of coil springs individually arranged in pockets formed of a casing material. The mattress has at least two parts of which at least one is a compactable part. Further, at least one elongate actuation member extends perpendicular to a compacting direction for the compactable part(s), corresponding to a width or length direction of the mattress, and is embedded within the mattress between two of the parts. The actuation member is moveable in the compacting direction to expand or contract at least one of the one or more compactable part(s) of the mattress. Elastic elements may further be provided to contract one or more of the compactable parts.

18 Claims, 12 Drawing Sheets

(56) References Cited

U.S. PATENT DOCUMENTS

| | | | | |
|---|---|---|---|---|
| 2010/0317930 | A1* | 12/2010 | Oexman ..... | A47C 31/123<br>600/300 |
| 2010/0325810 | A1 | 12/2010 | Dahlin et al. | |
| 2011/0258772 | A1 | 10/2011 | Verschuere et al. | |
| 2015/0320229 | A1 | 11/2015 | Edling et al. | |
| 2017/0086597 | A1 | 3/2017 | Dahlin et al. | |

FOREIGN PATENT DOCUMENTS

| | | | |
|---|---|---|---|
| EP | 2245967 | A1 | 11/2010 |
| EP | 2762042 | A1 | 8/2014 |
| EP | 2923610 | A1 | 9/2015 |
| WO | WO-99/65366 | A1 | 12/1999 |
| WO | WO-2009/120270 | A2 | 10/2009 |

* cited by examiner

MATTRESS ARRANGEMENT, SUCH AS A BED, HAVING ADJUSTABLE FIRMNESS

FIELD OF THE INVENTION

The present invention relates to a mattress arrangement, such as a bed arrangement, having adjustable firmness. It also relates to a pocket spring mattress useable in such a mattress arrangement, and to a method for controlling such a mattress arrangement.

BACKGROUND OF THE INVENTION

In mattress arrangements, such as in a bed arrangement or other seating or furniture arrangements, a support is provided to act on the weight or part of the weight of a user, wherein the bed distributes the weight from the body of the user over a part of a surface of the device. Depending on how the bed distributes the weight of the user, the bed will appear as being either soft or firm. The degree of firmness of such a bed is dependent on the properties of the elastic elements, such as the spring constant, and how the elastic elements have been mounted in the bed, such as the degree of clamping or pre-tensioning. Thus, the firmness of the bed is normally set at the manufacturing of the device.

However, different persons wish and require different firmness. Further, different body parts may require different firmness.

It is known to provide bed arrangements with variable firmness. By inducing deformation to the elastic elements to different degrees, the firmness of the device is adjustable. The deformation member has the ability to deform the elastic element independently from the deformation of the elastic element induced by the being. This means that the firmness of the bed is adjustable during initialization, according to the wishes of the user. It is also possible to compensate the firmness of the device for possible changes in the elastic properties of the elastic arrangement over time. Such known solutions are e.g. disclosed in EP 2 245 967 and WO 2009/120270.

Further, it is known to provide variation in firmness of a mattress by arranging coil springs on support plates having variable height. The height of the support plates may be controlled by rotatable elements arranged under the support plates, and having an off-centre rotation axis. Hereby, by rotation of the rotatable elements, the plates assume various height positions. Such firmness adjustment means are e.g. discussed in U.S. Pat. No. 3,340,548 and US 2011/0258772. It is also known to use a similar arrangement with support plates having variable height where the height of the support plates may be controlled by displacement members in the form of linear motors, jacks, and other types of lifting mechanism. Such firmness adjustment means are e.g. discussed in AU 55 13 00, U.S. Pat. No. 4,222,137, US 2006/0253994, WO 99/65366 and EP 2 245 967.

However, common problems with these previously known bed arrangements with variable firmness are that they are relatively complex, heavy and costly to produce. Further, these known bed arrangements are also often relatively difficult and cumbersome to use. Further, even though these known bed arrangements provide a certain degree of adjustability, this is often inadequate for the users' needs.

Another approach is presented in U.S. Pat. No. 8,176,589, by the same applicant as in the present application, in which the bed has a variable width, and the mattress is arranged to be expanded/contracted together with the expansion/contraction of the bed frame. However, a significant drawback of this approach is that the size of the bed varies significantly.

Still further, EP 2 923 610 by the same applicant discloses a bed arrangement with two mattresses, wherein the lower mattress is allowed to expand and contract, and a plate arranged between the two mattresses, thereby concealing the empty spaced created when the lower mattress is contracted. However, this solution is also relatively complex and costly, and also the plate is a disadvantage in certain situations and for certain applications.

It is therefore still a need for a mattress arrangement, and in particular a bed arrangement, with adjustable firmness which alleviates the above-discussed problems.

SUMMARY OF THE INVENTION

It is therefore an object of the present invention to at least partly overcome these problems, and to provide an improved mattress arrangement.

These, and other objects that will be apparent from the following, are achieved by a mattress arrangement and a method for controlling a mattress arrangement, according to the appended claims.

According to a first aspect of the invention, there is provided a pocket spring mattress arrangement comprising:

a pocket spring mattress having a plurality of pocketed units of coil springs individually arranged in pockets formed of a casing material, said pocket spring mattress having at least two parts of which at least one is a compactable part; at least one elongate actuation member extending perpendicular to a compacting direction for said compactable part(s), said compacting direction corresponding to a width or length direction of the mattress, and being embedded within the mattress between two of said parts, said actuation member being moveable in the compacting direction to expand or contract at least one of the one or more compactable part(s) of the mattress.

The mattress arrangement may be a bed arrangement, but other types of seating or furniture arrangements are also feasible. In particular, the mattress arrangement comprises a mattress, e.g. in the form of a bed mattress, a cushion or the like, for accommodating the weight of a user. Such mattresses may e.g. be used in seats for all sorts of vehicles, upholstered furniture, davenports, bed arrangements and the like.

The mattress arrangement may further comprise a bed frame or the like, on which the mattress rests.

Further mattress(es), padding layer(s), etc may also be provided. Further, the whole mattress arrangement may also be commonly enclosed in a cover fabric.

The compaction of the mattress preferably occurs in the length direction of the mattress, but may alternatively or additionally occur in the width direction.

The sleeping/sitting/resting experience, and what is considered comfortable and not, varies greatly from person to person. Further, a user often may find it more comfortable to have a softer mattress when using one lying position, such as on the stomach, i.e. in a prone position, or on the side, than when resting in other sleeping positions, such as on the back, i.e. in supine position. The present invention provides an efficient, yet relatively simple and cost-efficient, way of varying the mattress properties in dependence of the user's wishes, and e.g. based on the choice of lying position. It has been found that this greatly improves the sleeping and resting experience, which provides better resting and sleeping quality. Improved sleep and rest also improves the health of the user, and overall leads to an improved quality of life.

Prior to the present invention, mattresses and seats/beds with adjustable properties were known to be complex, heavy and costly, and also difficult and cumbersome to use. In contrast, the present invention provides a mattress arrangement, such as a bed arrangement, with adjustable properties which weighs very little, is relatively simple and cost-efficient to produce, which is easy to operate for the user. The mattress arrangement also lends itself very well for automated or semi-automated manufacturing.

Still further, the mattress arrangement of the present invention may provide fixed outer dimensions, since the contraction of the mattress may occur in distinct zones, the contraction being compensated by expansion of other zones. Thus, the overall size and appearance of the mattress arrangement remains the same, regardless of the firmness settings being used.

It has been found that by this variation of the extension and contraction of certain zones, a wide degree of different firmness settings for the mattress arrangement may be obtained. The firmness is also controllable in a very precise and predictable way.

The pocket spring mattress comprises a plurality of coil springs arranged in pockets. Most preferably, the pocket spring mattress comprises a plurality of parallel strings interconnected side by side, each string comprising a plurality of continuous casings and each casing comprising a coil spring, wherein expansion of the mattress into the expanded state occurs in a least one of a direction being parallel to the strings and a direction being perpendicular to the strings. Mattresses of these types are per se known. One mattress type which is suitable for use in connection with the present invention is the one disclosed in U.S. Pat. No. 8,176,589, by the same applicant, which relates to a pocket spring mattress in which a plurality of stretch openings are formed in the cover material forming the pockets, allowing the strings to be separated from each other. This document is hereby incorporated by reference. Another mattress type which is also suitable for use in connection with the present invention is the one disclosed in U.S. Pat. No. 7,048,263, also by the same applicant, which relates to a pocket spring mattress in which a separation distance is formed between adjacent springs/pockets within each string, allowing the mattress to be expanded and contracted in the direction of the strings. This document is hereby also incorporated by reference. Still another example of a mattress type which is suitable for use in connection with the present invention is the one disclosed in US 2007/124865, also by the same applicant, which relates to a pocket spring mattress in which a separation distance is formed between adjacent springs/pockets within each string, and wherein a slit opening is provided within each separation, further improving the capability of the mattress to be expanded and contracted in the direction of the strings. This document is hereby also incorporated by reference.

The strings are preferably arranged to extend in the length direction of the mattress.

The mattress may further assume at least one, and preferably a plurality, of intermediate states, between the expanded state and the contracted state. In a preferred embodiment, the mattress is continuously controllable to be set in any intermediate state between the expanded state and the contracted state.

The mattress preferably has fixed outer dimensions. Hereby, the outer boundaries of the mattress remain the same during adjustment of the firmness of the mattress. Preferably, the mattress may comprise at least two compactable parts, wherein said elongate actuation member is arranged to contract one of said compactable parts while simultaneously expanding the other compactable part. Hereby, one of the parts may be contracted simultaneously and to the same degree as the other is expanded. However, more than two parts may also be provided. If e.g. three parts are used, two parts may be contracted while the other, preferably arranged between the other two parts, is expanded, and vice versa. Hence, the length of expansion and contraction of the central part may be correspondingly assumed by the other two parts, in equal or different shares.

Hereby, the mattress maintains the same size at all times. At the same time, it has been realized by the present inventor that certain parts of the mattress are more sensitive and more important in respect of firmness adjustment than others. For example, it is generally of more importance to make the central part of the mattress, underlying the user's buttocks, adjustable, and in particular the region between a user's hip/buttocks and shoulder, than the parts towards the end of the mattress, underlying the user's head and legs, respectively. By means of the present invention, adequate adjustment possibilities are provided for the more sensitive parts, and these adjustments, realized as a contraction or expansion, are compensated by a corresponding adjustment of the other parts. Thus, if the user wants a firmer mattress, the part underlying the user's buttocks is made firmer by contracting this part. At the same time, one or more other parts are made less firm, but this would generally be hardly noticeable for the user. Thus, the overall impression for the user is that the mattress has been made firmer, even though there has in fact only been a redistribution of the firmness of the mattress. In the same way, if the user wants a softer mattress, the part underlying the user's buttocks is made softer by contracting this part. At the same time, one or more other parts are made less soft, but this would again generally be hardly noticeable for the user. Thus, the overall impression for the user is that the mattress has been made softer, even though there has again in fact only been a redistribution of the softness of the mattress.

These two, three or more parts may be arranged sequentially after each other in the length direction of the mattress. However, alternatively, the two, three or more parts may be arranged sequentially after each other in the width direction of the mattress. Further, it is also feasible to have the separation between different parts in both a length direction and a width direction of the mattress. For example, the mattress may comprise nine parts, being arranged in three rows in the length direction and three columns in the width direction. The parts are separated from each other by the elongate actuation member(s). Thus, the parts may be formed within a single, integrated mattress core, or be formed by one or more separate mattress cores.

The mattress may comprise several adjustable/compactable parts, but may also comprise non-compactable parts. Thus, the mattress may comprises a combination of one or more compactable part and one or more non-compactable parts, but may also comprise a combination of two or more compactable parts without any non-compactable parts.

The pocketed units preferably comprise a plurality of parallel continuous strings interconnected side by side, each string being formed of a continuous casing material, enclosing a plurality of coil springs in individual pockets, forming a line of integrated pocketed units.

The continuous strings preferably extend in the compacting direction.

The pocket spring mattress arrangement may further comprise at least one elastic element arranged to provide a contraction force to bring the mattress, or part of the mattress, to the contracted state. Hereby, this part of the mattress will resume a contracted state when no exterior force is applied. This simplifies operation of the mattress. For example, the elongate actuation member may consequently be maneuvered in one direction, e.g. by being pulled by manipulation elements, and brought back in the other direction when release by means of the elastic elements. Further, the elastic elements may, additionally or alternatively, be used to ensure that the distribution of springs in this part of the mattress remains uniform also in every intermediate state, between an expanded state and a contracted state. The elastic element may e.g. a band, string, cord or the like of an elastic material. Preferably, a plurality of elastic elements is provided, being distributed over or within the mattress or the part of the mattress. Further, it is preferred that each elastic element is connected to the mattress at a plurality of distributed connection points. In particular, it is preferred that each elastic element is connected to a plurality of pockets, and preferably to each pocket it is in contact with.

The elastic element(s) may be arranged on the top surface of the mattress, on the lower surface of the mattress, at one or several sides of the mattress, integrated within the mattress, or any combination thereof. In a pocket spring mattress, at least some of the elastic elements may extend between adjacent rows/strings of pocketed springs.

The above-discussed elastic elements are arranged on or integrated in the mattress, and are used to provide a contraction of the mattress, to bring part of the mattress into a contracted state. At the same time, a counterforce is provided by means of the elongate actuation member for expanding a part of the mattress and bringing this part to an expanded or contracted state, or an intermediate state between the fully contracted state and the fully expanded state. By releasing the counterforce, the lower mattress is automatically contracted and brought back to a contracted state, being the resting or default state.

However, alternatively resilient elements, such as springs, may instead be arranged to automatically bring the mattress into an expanded state, in which case the counterforce of the elongate actuation member should instead be provided to bring this part of the mattress into a more contracted state, and whereby a release of the counterforce instead brings this part of the mattress back to an expanded resting or default state.

The at least one elastic element may extend between a first end and a second end in an extension direction, said extension direction corresponding to at least one of a length and width direction of the mattress, wherein said at least one elastic element is arranged to provide a contraction force to bring said first and second ends towards each other, thereby providing a contraction force to contract the one or more part(s) of the mattress extending between said first and second end(s) in the extension direction.

At least some of the elastic elements may be arranged above or underneath a line of pocketed units, and connected to at least some end surfaces of said pocketed units. Additionally or alternatively, at least some of the elastic elements may be arranged between lines of pocketed units, and connected to longitudinal surfaces of at least some of said pocketed units.

However, embodiments without any elastic elements are also feasible. For example, the elongate actuation member(s) may be maneuverable in two direction, thereby being actively maneuverable both for contraction and expansion.

The one or more elongate actuation member(s) may be provided by rods or plates of a relatively rigid material, such as wood, steel or the like. Preferably, the elongate actuation member(s) is very rigid in a movement direction, but may be less rigid, or even flexible, in a direction perpendicular to the movement direction. Hereby, the risk that the user may feel the elongate actuation member during use is even further diminished. Different flexibility in different directions can be obtained for example by hinge joints, by specific selection of shapes and materials, etc.

Preferably, the elongate actuation member(s) is (are) not arranged underlying a user's hip, buttocks or shoulders, thereby making the elongate actuation member(s) less discernible for the user.

In some embodiments, there may be only one single elongate actuaton member, arranged between two parts of the mattress. However, preferably, the mattress arrangement comprises at least two elongate actuation members, extending in parallel to each other and perpendicular to the compacting direction, and at a distance from each other, arranged between three parts of the mattress. Also, more than two elongate actuation members may be used, such as three, four or even more.

The elongate actuation member(s) may extend through pocket units. However, preferably, the elongate actuation members extend between rows of pockets units, such as between strings of pocket units, or through strings of pockets units. In the latter case, the elongate actuation members may be arranged through openings arranged between the pocket units in the strings.

The elongate actuation member(s) may be connected and attached to the mattress. However, alternatively, the elongate actuation member(s) may be loosely held within the mattress, such as being loosely received within opening of the strings or the like.

The elongate actuation member(s) may extend over at least 50% of the length of the width (if arranged along the width) or length (if arranged along the length) of the mattress, and preferably at least 70%, and most preferably at least 90%. Further, the elongate actuation member(s) may extend over less than the entire width or length of the mattress. However, in some embodiments, the elongate actuation member(s) may also have an extension exceeding the width or length, so that the ends of the elongate actuation member(s) extend out from the sides of the mattress. Hereby, movement of the elongate actuation members can be effected from the sides of the mattress, and manipulation need not occur within the mattress. This facilitates realization of the mattress, and also makes it more cost-efficient.

The elongate actuation members are preferably moved from a remote position, and are preferably maneuvered by means of manipulation elements. The manipulation elements may be manually operable elements, such as rods, wires and the like, being operable from a side of the mattress arrangement for moving the elongate actuation members to a desired position. However, preferably, the manipulation elements are connected to and controllable by an electrically operated actuator, such as a linear actuator, an electric hydraulic piston, an electric motor, or the like. Hence, movement of the elongate actuation members may be effected via a user interface, e.g. comprising control buttons, a touch screen or the like.

In one embodiment, the mattress arrangement comprises at least one manipulation element, such as a pulling wire, extending in the compacting direction, and connected to the at least one elongate actuation member, for controlled movement of the elongate actuation member in the compacting direction. Further, the mattress arrangement may comprise an electric actuator for controlled pulling of the manipulation element(s).

The manipulation arrangement may comprise a pulling or pushing arrangement, and may e.g. comprise one or several ropes, strings or the like connected to a side of the lower mattress or within the mattress. Such an arrangement is very cost efficient, and is in particular suitable for manual operation, but also for automated, electric maneuvering. In manual operations, the ropes/strings may e.g. be locked in a suitable pulled out position by a locking arrangement, be tied together, or in any other way secured. However, the ropes/strings may also be operated by an electric motor or the like. Further, the moveable side of the lower mattress may be connected to a rigid pulling or pushing element, which may be displaced automatically, by an electric motor or the like.

In case two or more elongate actuation members are provided, these may be independently maneuvered from two different sides of the mattress. However, they may alternatively be moved in correlation to each other, and preferably by being connected to a common manipulation arrangement.

According to another aspect of the invention, there is provided a method for adaptation of the firmness of a mattress arrangement, comprising the steps:

providing a pocket spring mattress, said pocket spring mattress having at least two parts of which at least one is a compactable part; providing at least one elongate actuation member extending perpendicular to a compacting direction for said compactable part(s), said compacting direction corresponding to a width or length direction of the mattress, and being embedded within the mattress between two of said parts, said actuation member being moveable in the compacting direction; and controlling the movement of the elongate actuation member(s) to expand and/or contract the one or more compactable part(s) of the mattress.

By means of this additional aspect of the invention, similar objects and advantages as discussed above in relation to the first aspect of the invention are obtainable.

BRIEF DESCRIPTION OF THE DRAWINGS

These and other aspects of the present invention will now be described in more detail, with reference to the appended drawings showing currently preferred embodiments of the invention.

FIG. 1*a* shows the mattress arrangement in a firmer state, and FIG. 1*b* shows the mattress arrangement in a softer state;

FIGS. 6*a* and 6*c* illustrates the mattress in an expanded state and FIG. 6*b* illustrates a contracted state;

FIG. 7*a* illustrates the mattress in an expanded state, and FIG. 7*b* illustrates the mattress in a contracted state;

DETAILED DESCRIPTION

In the following, the invention will be exemplified by means of bed arrangements. However, it is to be acknowledged by the skilled reader that the same principles and functions may also be used in other types of mattress arrangements using mattresses, e.g. in the form of a bed mattress, a cushion or the like, such as seats for all sorts of vehicles, upholstered furniture, and the like. Accordingly, when reference in the following is made to a bed or bed arrangement, it is to be understood that this may also be used in other types of mattress arrangements, and in particular other types of furniture arrangements.

Figure 1A:
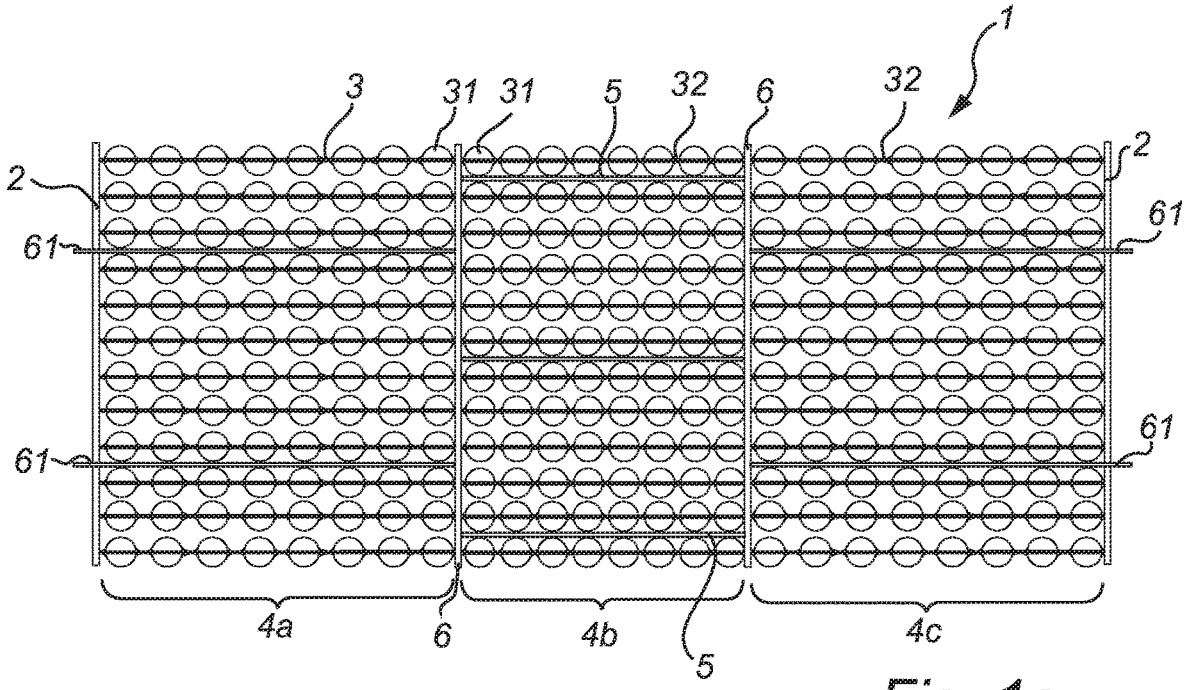
FIG. 1*a-b* show a schematic top view of an embodiment of a mattress arrangement according to the present invention, where

A mattress arrangement having a mattress 1 with adjustable firmness according to a first embodiment of the invention is shown schematically in FIG. 1*a*. The bed arrangement comprises a frame, including side walls 2 arranged at the head side and foot side of the bed. The bed arrangement further comprises a pocket spring mattress 3, comprising a plurality of coil springs individually arranged in separate pockets of a casing material to form pocket units 31, to define a pocket spring mattress. The pocket units are preferably provided in elongate strings 32, each comprising a plurality of pocket units and connected together by a continuous casing material extending over the entire string. Preferably, several such strings are connected to each other, e.g. by adhesive, in a side-by-side arrangement.

The mattress defines at least two, and preferably at least three parts 4*a*, 4*b*, 4*c* with adjustable firmness. In the illustrative example, three parts are provided. These parts may be formed of separate pocket mattresses elements, or be formed of a continuous mattress element extending over two or more zones.

The mattress further preferably comprises at least one elastic element 5 arranged to provide a contraction force to contract one or more of the part(s) of the mattress in a compacting direction. In this embodiment, such elastic elements 5 are arranged in the central part 4*b*. However, elastic elements may additionally or alternatively be provided in one or more of the other parts, and may also, alternatively, extend over several parts, or all the parts, as will be discussed in more detail in the following.

The elastic elements 5 of this embodiment provides a contraction of the central part 4*b*, thereby compacting this part in the length direction of the mattress. However, in other embodiments, the compacting may alternatively or additionally be made in the width direction of the mattress.

Further, at least one elongate actuation member 6 is provided. This elongate actuation member 6 extends perpendicular to the compacting direction, i.e. in the width direction in this embodiment. The elongate actuation member is preferably rigid or relatively rigid, and may e.g. be realized as a rod, a narrow plate or the like. The elongate actuation member(s) is moveable in the compacting direction, i.e. here the length direction, of the mattress, and is embedded in the mattress. Hereby, the elongate actuation member(s) is useable to contract or expand one or more of the parts of the mattress. If the elongate actuation member(s) is maneuverable both to contract and expand the parts, the elastic elements may optionally be omitted.

In the illustrative example, two elongate actuation members are provided, arranged between the first part 4*a* and the second part 4*b*, and between the second part 4*b* and the third part 4*c*, respectively.

In the illustrative example, the elastic elements 5 are connected to the elongate actuation members. However, in other embodiments, the elastic elements may also be connected to one or both of the side walls. Further, the elastic elements may additionally or alternatively be connected to pocket units of one or several of the mattress parts.

The elongate actuation members are preferably moveable by manipulation elements 61, here in the form of strings, wires, cords, bands, rods or the like attached to the elongate actuation members 6, and extending through or beneath the adjacent mattress parts 4*a* and 4*c* to the side walls 2. Thus, by pulling the manipulation elements 61, the elongate actuation member will move towards the side wall, thereby expanding the central mattress part, and correspondingly compacting the mattress part between the elongate actuation member and the side wall. The manipulation elements 61 are preferably fixable in one or more retracted positions, and preferably in several or even all possible retracted positions.

Figure 1B:
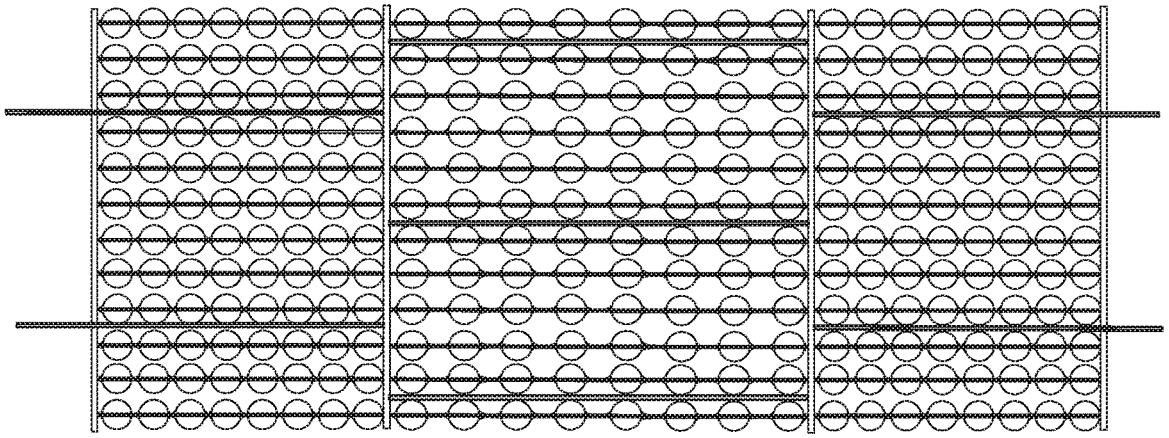

Thus, in this illustrative example, when the manipulation elements 61 are in an extended of free position, the elastic elements 5 will move the elongate actuation members 6 together, thereby expanding the mattress parts 4*a* and 4*c* at the sides, and compacting the central mattress part 4*b*. This increases the firmness of the mattress experienced by the user. Such a firmer state is illustrated in FIG. 1*a*. By pulling the manipulation elements 61 to a retracted position from one or both of the short sides, the elongate actuation members 6 will be moved closer to the respective side wall 2, thereby expanding the central mattress part 4*b*, and compacting the mattress parts 4*a* and 4*c* at the sides. This will increase the softness of the mattress experienced by the user. Such a softer state is illustrated in FIG. 1*b*. In this embodiment, the elongate actuation members are actively moveable only in one direction, and are automatically retracted by the elastic elements. However, the elongate actuation members may alternatively be actively moveable both back and forth.

The sides of the mattress being closest to the short sides are preferably connected or fixed in relation to the frame, thereby maintaining a fixed outer boundary of the mattress during adjustment. For example, the pockets closest to the short sides may be connected to the side walls 2. Alternatively, rods or the like attached to the frame may be arranged at the short sides, and connected to the mattress, e.g. by being attached to the pocket units closest to the short sides, or being arranged between the rows of pocket units closest to the short sides.

The mattress arrangement may also comprise an external cover, one or more additional mattresses, and the like. Such embodiments are illustrated in FIGS. 2 and 3.

Figure 2:
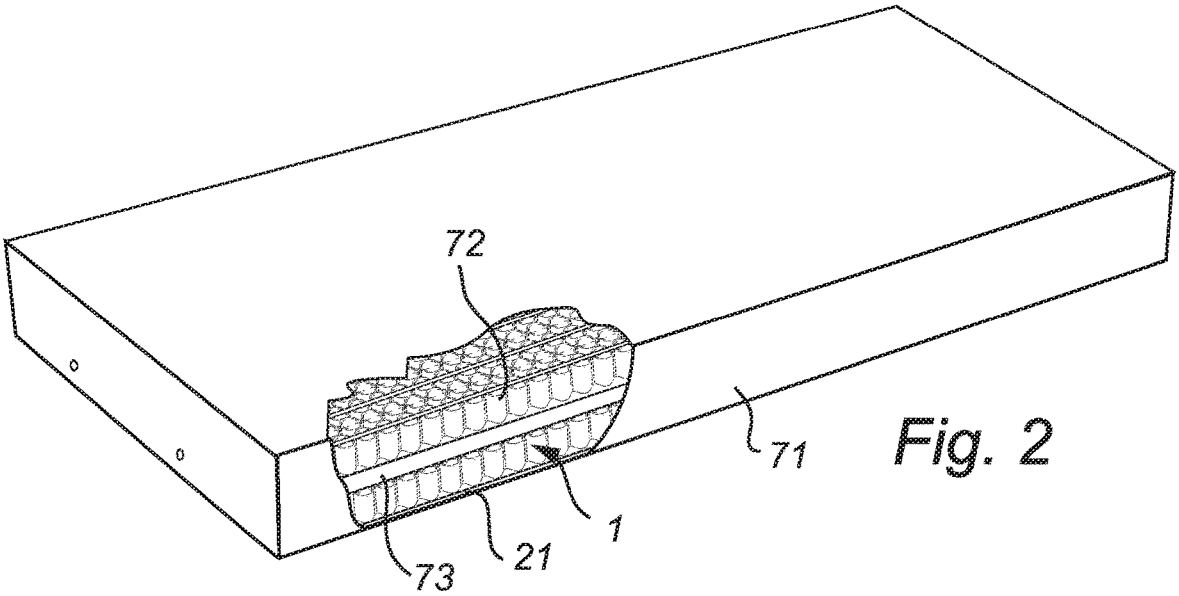
FIG. 2 shows a perspective view of a mattress arrangement in accordance with an embodiment of the present invention, where a cut-out section in the middle shows the interior of the mattress arrangement.
Figure 3:
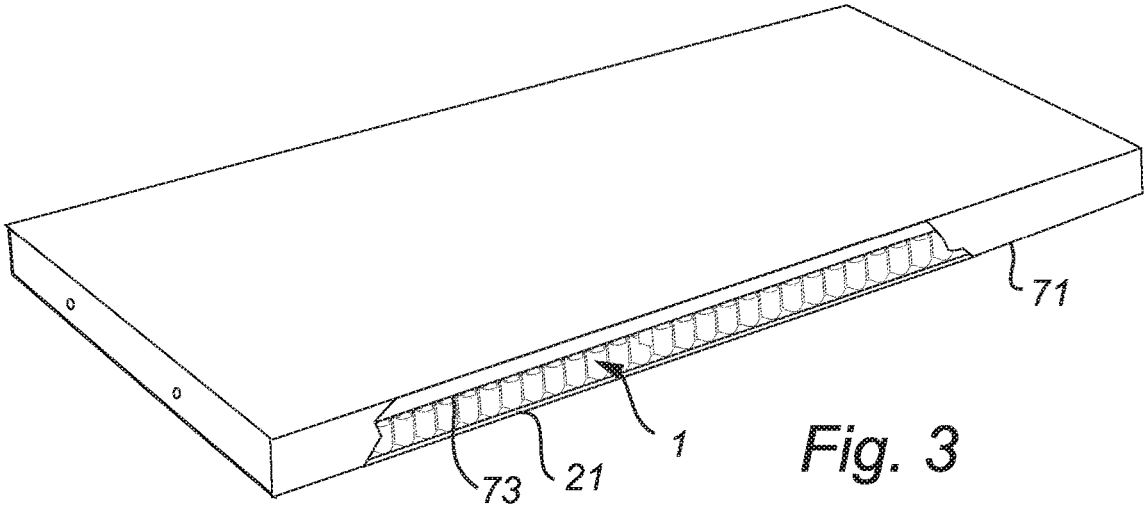
FIG. 3 shows a perspective view of a mattress arrangement in accordance with another embodiment of the present invention, where a cut-out section in the middle shows the interior of the mattress arrangement.

With reference to FIG. 2, the mattress arrangement comprises a cover 71, enclosing an adjustable mattress, e.g. of the type discussed above, and an additional upper mattress. In a cutout section in the middle the interior of the mattress arrangement is visible. The mattress arrangement comprises an adjustable lower mattress 1, an upper mattress 72, and a frame 21. A further padding layer 73 or the like may be provided between the upper and lower mattress. The frame 21 may be connected to or integrated with the frame side walls 2 (see FIG. 1*a*), and may also be connected to or integrated with additional side walls, e.g. extending along the long sides of the mattress arrangement.

However, the provision of an upper mattress 72 is not necessary, and in simpler configurations, only the adjustable mattress 1 may be provided. Such a simpler configuration is illustrated in FIG. 3. Here, the mattress arrangement also comprises a cover 71, enclosing an adjustable mattress 1, e.g. of the type discussed above. In a cutout section in the middle the interior of the mattress arrangement is visible. The mattress arrangement comprises an adjustable mattress 1 and a frame 21. A further padding layer 73 or the like may be provided on top of the adjustable mattress 1.

The mattress is a pocket spring mattress, comprising several parts, being integrated into a single pocket core, or provided as individual, separate pocket cores. The pocket core(s) is preferably arranged as continuous strings, being connected to each other. Expansion of the mattress into the expanded state occurs in a least one of a direction being parallel to the strings and a direction being perpendicular to the strings. Each string is preferably formed by continuous cover material, and the separation between adjacent pockets being formed by lateral separation joints. These separation joints, as well as longitudinal joints, may be formed through any form of adhesive bonding, welding, stapling, sewing, or any combination thereof. In a preferred embodiment, welding is used. Coil springs of many different sizes could be used in conjunction with the present invention, and in principle any desired spring size, large or small, may be used. Preferably, however, the coil springs have a diameter in the range 2-10 cm, and preferably in the range 4-8 cm, such as 6 cm. In addition, the coil springs are preferably manufactured from helically coiled wires. The springs preferably comprise at least three turns, and preferably fewer than 10 turns. Moreover, they are advantageously made of spiral wire with a thickness in the range 0.5-3.0 mm, preferably a wire thickness in the range 1.25-2.50 mm. Preferably the springs are slightly spool-shaped, that is with smaller turns at the top and bottom. Mattresses of these types are per se known.

Figure 4A:
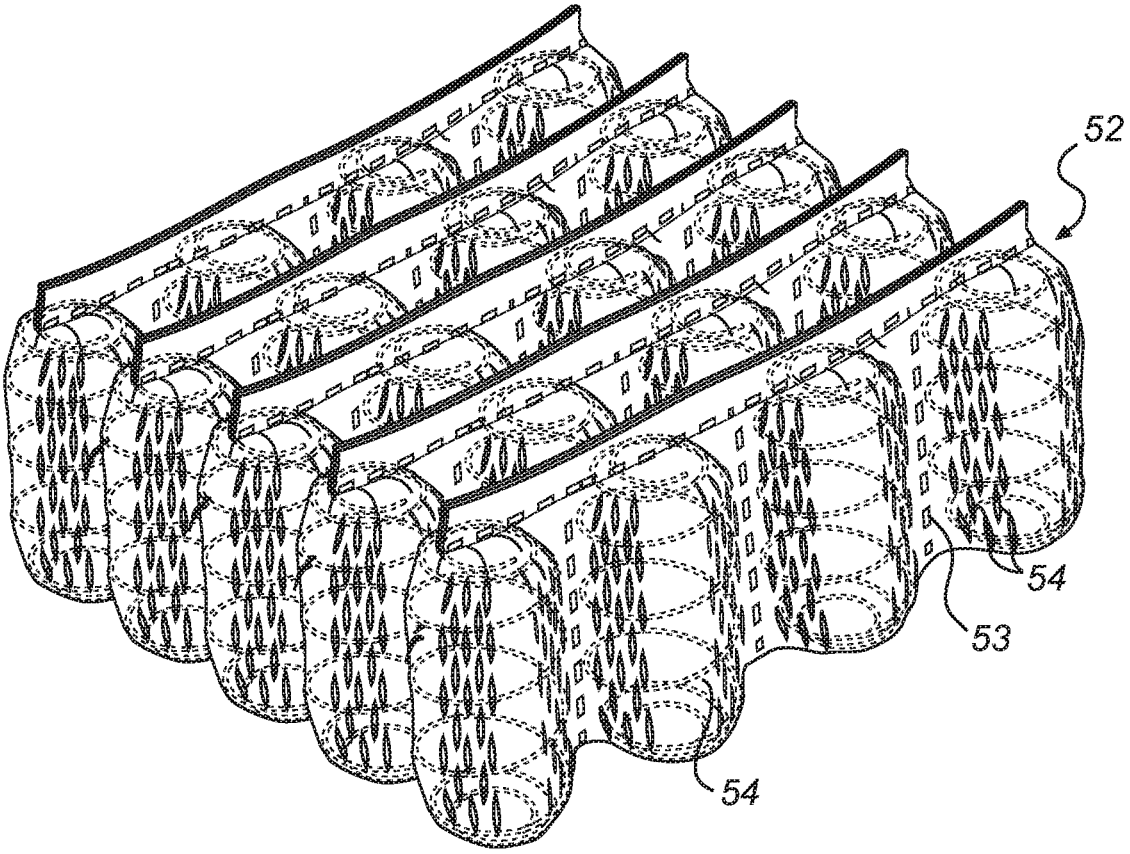
FIGS. 4*a* and 4*b* show an embodiment of the mattress, illustrated in a perspective side view and a top view, respectively.
Figure 4B:
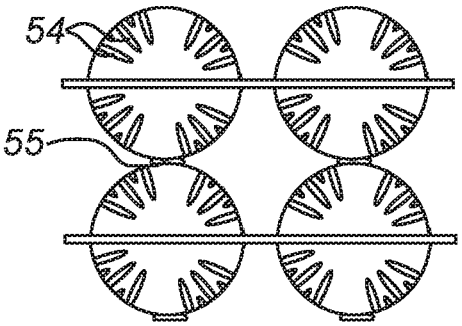

One mattress type which is suitable for use as the lower mattress is the one disclosed in U.S. Pat. No. 8,176,589, by the same applicant, said document hereby incorporated in its entirety by reference. Such a mattress is illustrated in FIGS. 4*a* and 4*b*. This pocket spring mattress comprises pocket units 31 arranged in strings 32. In each pocket there is a coil spring. Each string is made of a continuous cover material, and the pockets are formed by separation joints 33, e.g. formed by welding. The strings are connected to each other in parallel in a side-by-side arrangement, by connections 35. These connections may be formed by adhesive, but may alternatively be effected by welding, Velcro or the like. Further, the pockets are provided with a plurality of stretch openings 34, providing a net-like surface structure. This allows the strings to be separated from each other. Thus, a mattress of this type can be expanded in a direction perpendicular to the length direction of the strings.

Figure 5:
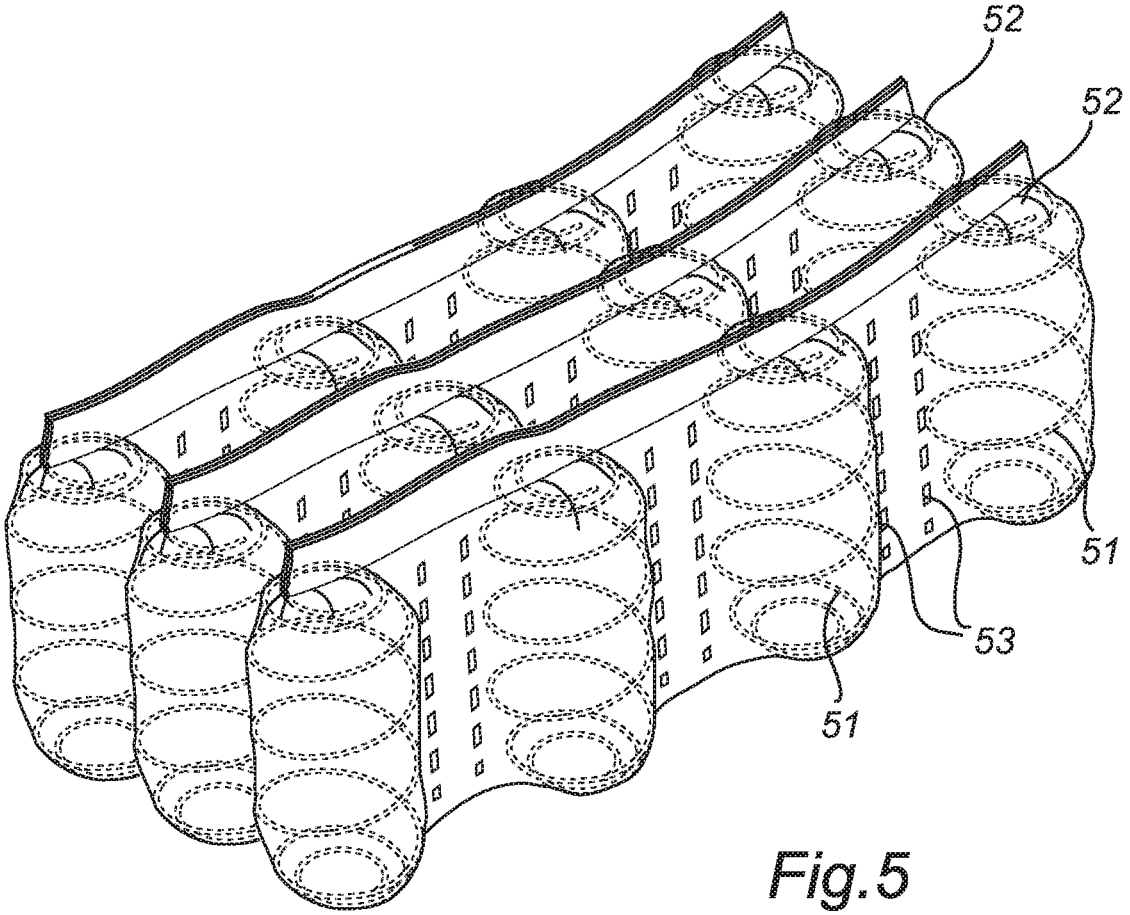
FIG. 5 shows another embodiment of the mattress, illustrated in a perspective side view.

Another mattress type which is suitable for use as the lower mattress is the one disclosed in U.S. Pat. No. 7,048,263, also by the same applicant, said document also being incorporated by reference in its entirety. Such a mattress is illustrated in FIG. 5. This mattress has the same general structure as in the previous example, with coil springs being arranged in pockets 31, forming strings 32 that are connected to each other in parallel. However, in this embodiment an increased separation distance between the pockets/springs in each string is provided. This may be effected by provision of two spaced apart separation joints 33', or alternatively by using wide separation joints or the like. Hereby, a separation distance is formed between adjacent springs/pockets within each string, allowing the mattress to be expanded and contracted in the direction of the strings.

Figure 6A:
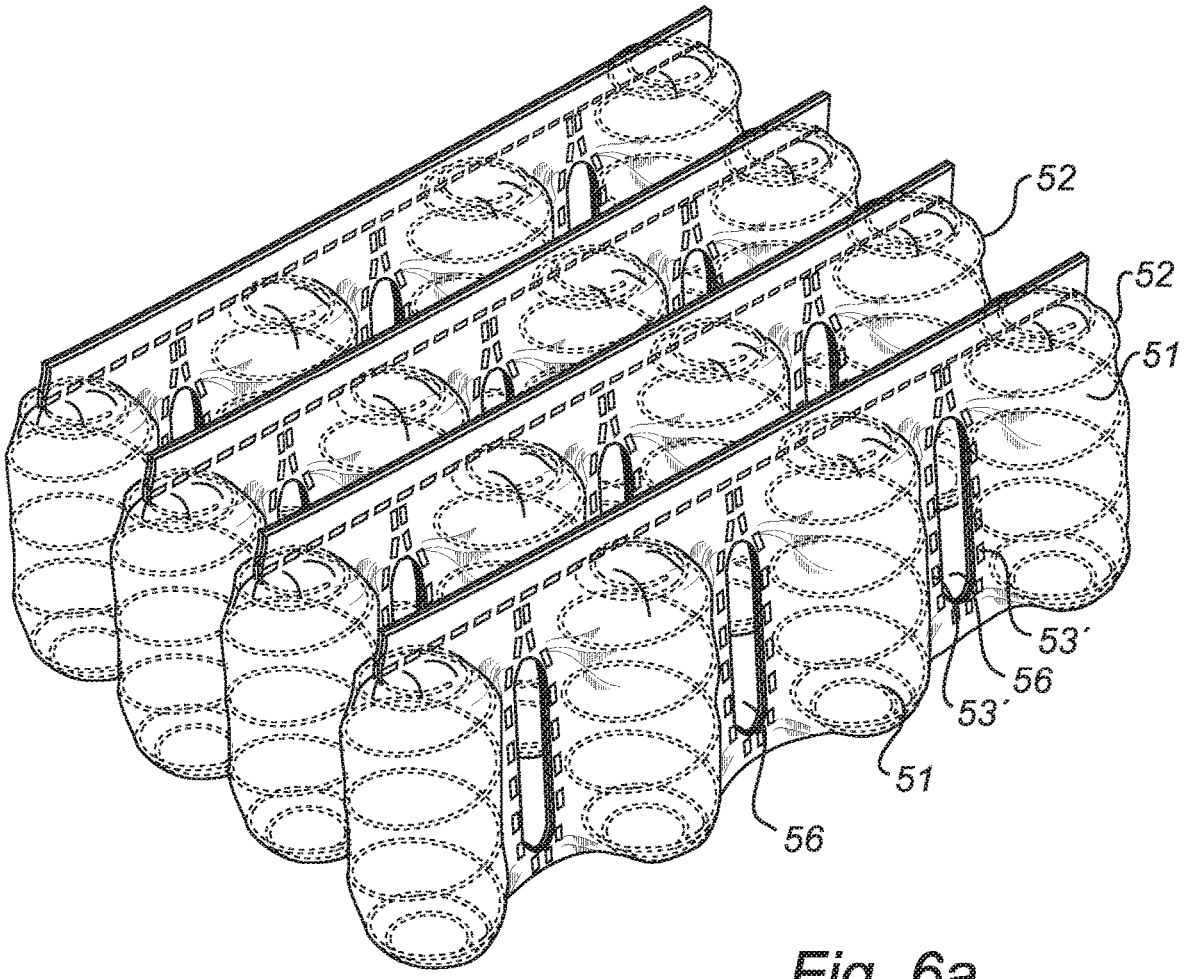
FIGS. 6*a-c* show still another embodiment of the mattress, illustrated in a perspective side view and a side views, respectively, where
Figure 6B:
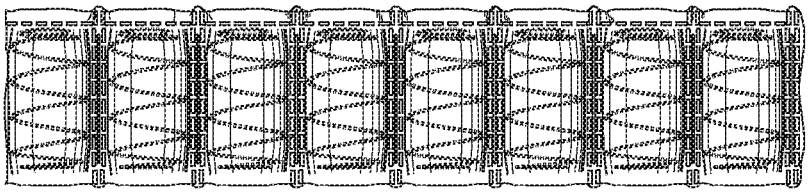
Figure 6C:
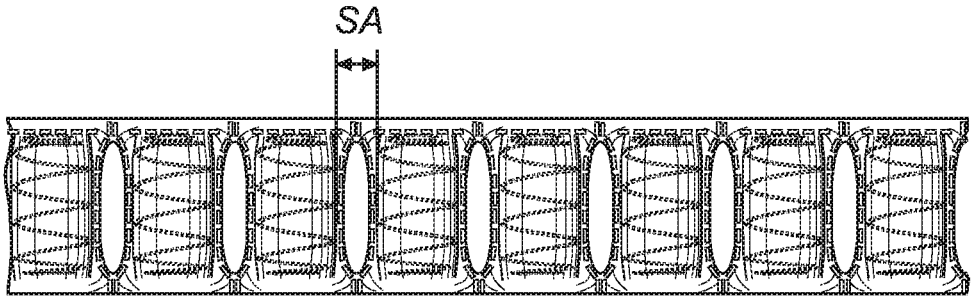

Still another mattress type which is suitable for use as the lower mattress is the one disclosed in US 2007/124865, also by the same applicant, said document also being incorporated by reference in its entirety. Such a mattress is illustrated in FIGS. 6*a-c*. This mattress has the same general structure as in the previous example, with coil springs being arranged in pockets 31, forming strings 32 that are connected to each other in parallel. Further, there is provided an increased separation distance between the pockets/springs in each string is provided, effected by provision of two spaced apart separation joints 33' or the like. To further increase the flexibility of the strings, slit openings 36 are provided between pockets, and between the separation joints 33'. The slit openings are preferably enclosed within the material, without any open ends. FIG. 6*b* illustrate this mattress in a contracted state, whereas FIG. 6*c* illustrate the same mattress in an expanded state.

Another mattress type which is suitable for use as the lower mattress is similar to the one disclosed with reference to FIG. 5 above. However, in this embodiment, illustrated in FIG. 7, the strings are generally conventional pocket springs, but with every second pocket left unfilled. Accordingly, here the only half of the pockets contain a coil spring. Thus, each string 32 here contains coil springs being arranged in every second pocket 31, and an increased separation distance between the pockets/springs in each string is provided by leaving every other pocket unfilled, without any coil spring. Thus, a separation distance is formed by the separation joints 33 adjacent to every unfilled pocket, allowing the mattress to be expanded and contracted in the direction of the strings.

At least one part of the mattress further comprises at least one elastic element extending through the mattress or the part of the mattress, and between a moveable side and an opposite side of the mattress, or mattress part, wherein the at least one elastic element is arranged to provide a contraction force to bring the mattress or mattress part to the contracted state. Hereby, the mattress or mattress part will resume a contracted state when no exterior force is applied. This simplifies operation of the mattress and also ensures that the distribution of springs in the mattress or mattress part remains uniform also in every intermediate state, between the expanded state and the contracted state. The elastic element may e.g. a band, string, cord or the like of an elastic material. Preferably, a plurality of elastic elements is provided, being distributed over or within the mattress or mattress part. Further, it is preferred that each elastic element is connected to the mattress or mattress part at a plurality of distributed connection points. In particular, it is preferred that each elastic element is connected to a plurality of pockets, and preferably to each pocket it is in contact with. Specifically, such elastic elements may be combined with any of the pocket spring mattress types discussed above in relation to FIGS. 4-7.

Figure 7A:
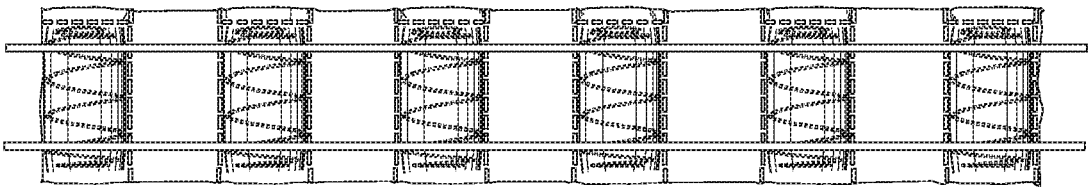
FIGS. 7*a-b* show still another embodiment of the mattress, illustrated in side views, and with elastic elements being provided to retract the mattress to a contracted state, where
Figure 7B:
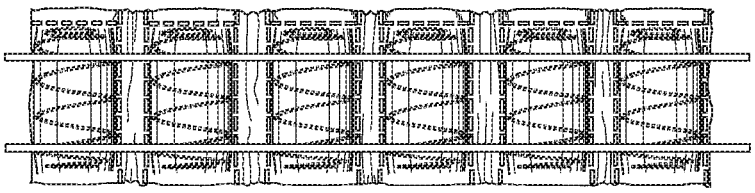

In the embodiment of FIG. 7, elastic elements 5 are connected to the sides of the pocket units, and extending in parallel to the string direction. In this embodiment, an upper and a lower elastic element are provided, one being arranged adjacent but separated from the top of the pocket units, and one being arranged adjacent but separated from the bottom of the pocket units. However, alternatively, only one elastic element may be provided, e.g. being centrally arranged, or more than two elastic elements may be used. The elastic elements may be formed by elastic bands or elastic cord. The elastic elements may extend continuously over the entire length of the mattress, or over essentially the entire length of the mattress. However, separated elastic elements may alternatively be provided at each mattress part. Further, the elastic elements may be arranged between all strings of the mattress, or alternatively between only some of the strings. Additionally or alternatively, the elastic elements may be arranged at the outer sides of the mattress. As discussed above, the elastic elements may also, in some embodiments, be omitted.

In FIG. 8, some alternative ways of providing such elastic elements 5 are illustrated.

Figure 8A:
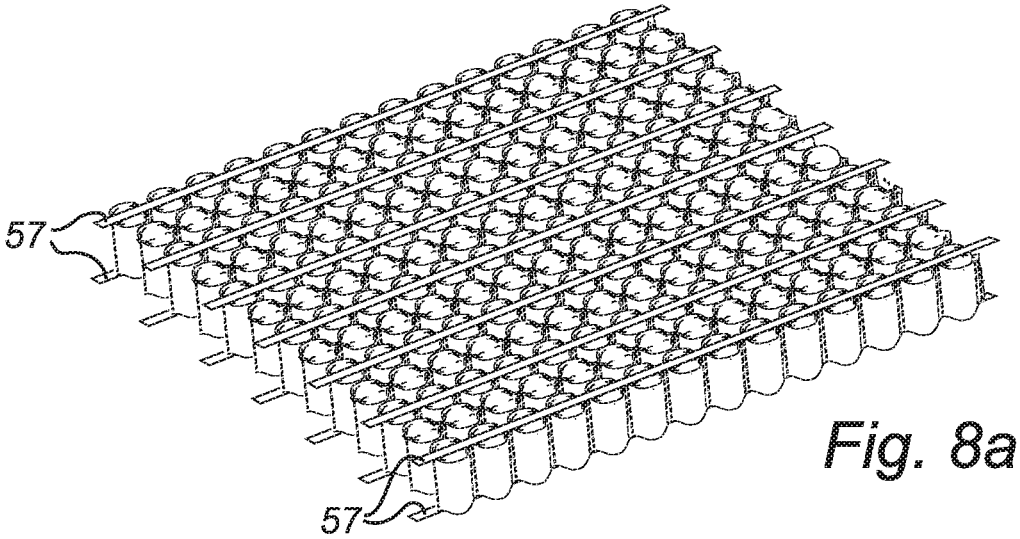
FIGS. 8*a-e* illustrate various further embodiments of the lower mattress having elastic elements to retract the mattress to a contracted state or to expand the mattress to an expanded state.

In FIG. 8*a*, a pocket spring mattress is illustrated in which elastic elements 5 are arranged on the top and bottom of the mattress. In the illustrated example, elastic elements are arranged both on the top and the bottom of the mattress, but alternatively elastic elements may be arranged only at the top or only at the bottom. Further, the elastic elements are here arranged aligned with the strings. However, alternatively or additionally, elastic elements may also be arranged perpendicular to the string direction. Further, in this example, elastic elements are arranged along each string, but fewer elastic elements may also be used. The elastic elements are preferably connected at to the strings at a plurality of positions, such as to every pocket it comes into contact with.

Figure 8B:
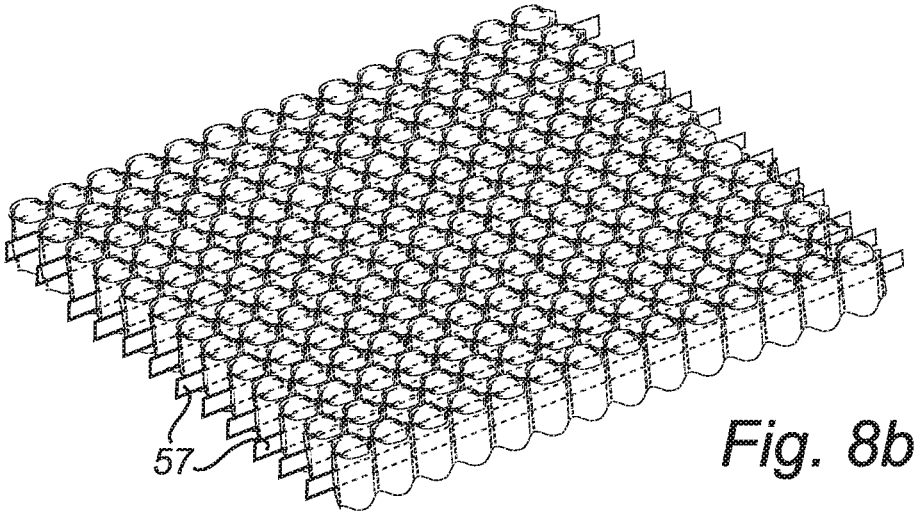

Alternatively or additionally, the elastic elements 5 may be arranged on the sides of the mattress, and in between the strings. Such an embodiment is illustrated in FIG. 8*b*. In this embodiment, elastic elements are provided between each pair of strings. Again, fewer elastic elements may be used, and an example of such an embodiment is illustrated in FIG. 8*c*.

Figure 8C:
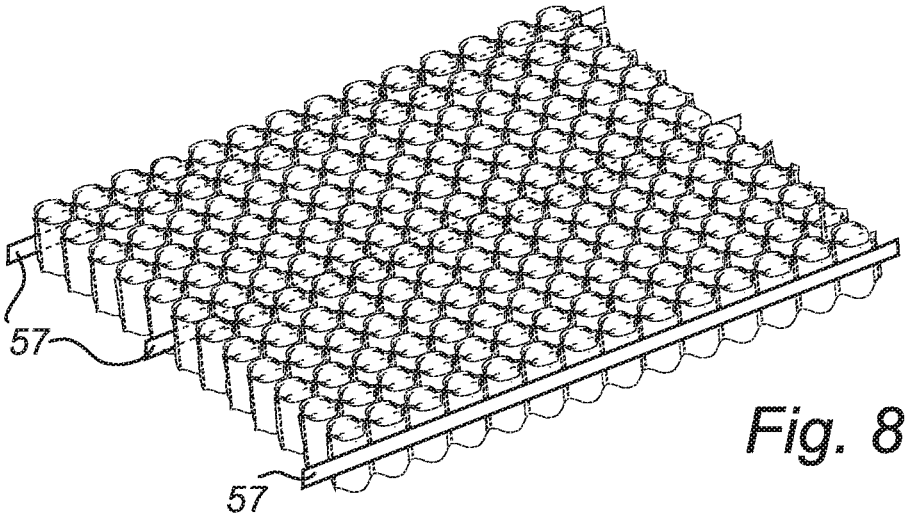
Figure 8D:
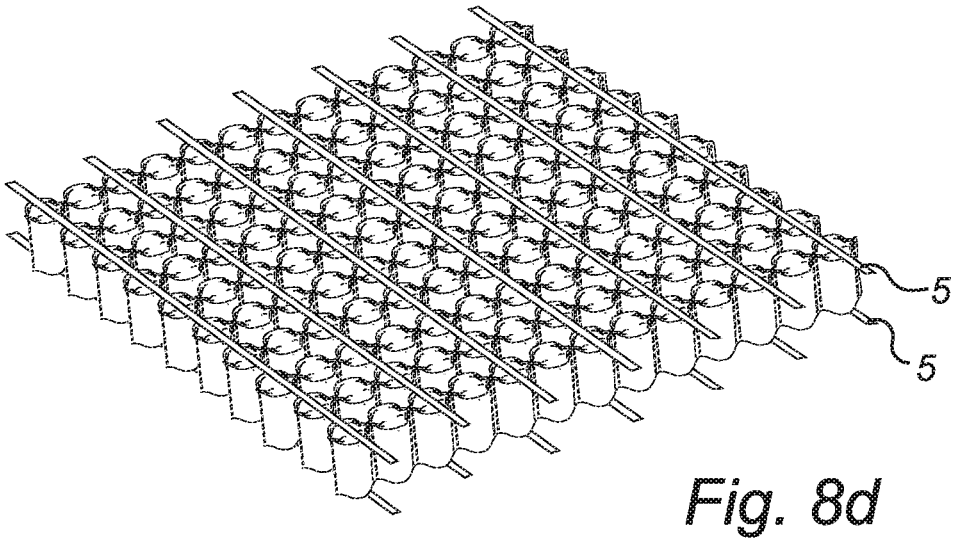

In the embodiments illustrated in FIGS. 8*a-c*, the elastic elements 5 are arranged in parallel with the strings of the mattress. However, the contraction and expansion of the mattress may, as has already been discussed in the foregoing, occur in a direction perpendicular to the string direction. In such a mattress, the elastic elements may instead be arranged with an orientation perpendicular to the string direction. Such an embodiment is illustrated in FIG. 8*d*.

Figure 8E:
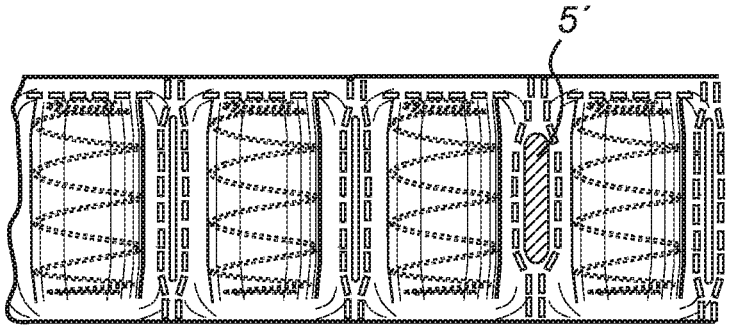

In the embodiments discussed with reference to FIGS. 8*a-d*, the elastic elements are arranged to exert a force to bring the mattress to a contracted state. However, the elastic elements may instead be arranged to exert a force to bring the mattress to an expanded state. Such an embodiment is illustrated in FIG. 8*e*. Here, the elastic elements 5' may be formed of an elastic compressible material, such as latex or polyether, and arranged to be compressed between the springs when the mattress is contracted, and thereby providing a force to expand the mattress again when the contraction force is removed. In the illustrative example of FIG. 8*e*, the elastic compressible material is arranged between adjacent springs within the same string/row of the mattress. However, additionally or alternatively, the elastic compressible material may be arranged between adjacent springs within neighboring strings/rows, i.e. arranged between adjacent strings/rows, rather than being in-line with the strings/rows.

Figure 9:
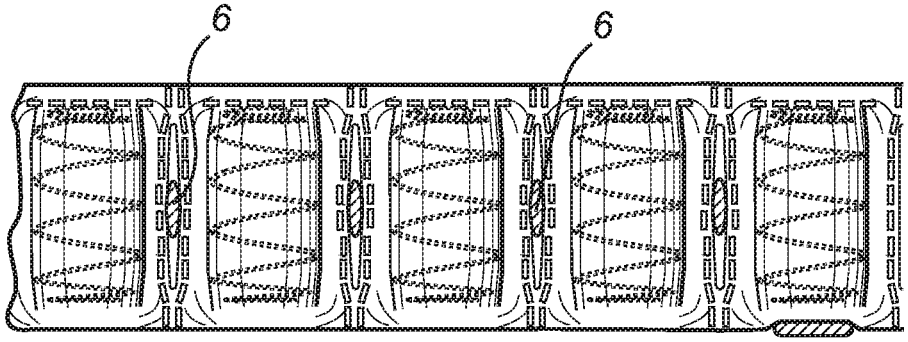
FIG. 9 schematically illustrate possible positioning of elongate actuation members through a pocket string.

The elongate actuation member may also be provided in openings within the strings. Such an illustrative example is shown in FIG. 9, where two elongate actuation members are shown in an exemplary fashion. As already discussed, a limited number of elongate actuation members is normally sufficient, such as one, two or three.

Movement of the elongate actuation member(s) may be effected by manipulation elements, such as a push or pull arrangement. The manipulation elements are thus preferably arranged to exert a pulling or pushing force to the elongate actuation member(s) from a distance, thereby effecting contraction and/or expansion of the corresponding mattress parts. The manipulation elements may be in the form of solid rods, etc, which are able to be manipulated from an outer side of the mattress arrangement. However, preferably, the manipulation elements are in the form of a flexible, elongate structure, such as cords, wires, strips or the like. The manipulation elements are preferably not stretchable, and non-elastic. For example, the manipulation elements may be realized as steel wires.

The manipulation elements may extend underneath the mattress, at the sides of the mattress or through the mattress.

The manipulation elements may be manually manipulated, and may be lockable at any desired position by suitable locking or securing arrangements, such as clamps, by being tied together and the like.

However, the manipulation elements may also be operated by an electric motor or the like. A knob, wheel, depressible buttons, a touch screen or any other type of user interface may then be operated resulting in a corresponding displacement of the elongate actuation member(s).

Some embodiments of such manipulation elements will be illustrated in the following.

Figure 10A:
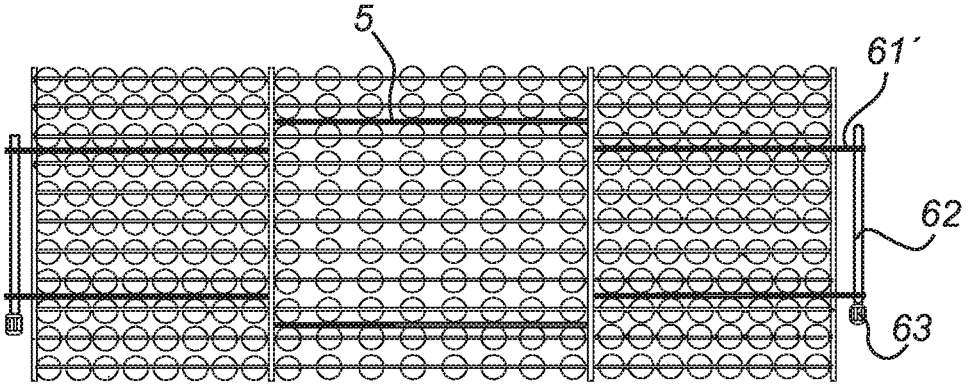
FIG. 10*a-c* illustrate various embodiments of the present invention including inter alia different types of electrically operated manipulation elements.

The embodiment of FIG. 10*a* resembles the embodiment discussed in relation to FIG. 1. In FIG. 10*a*, manipulation elements 61, e.g. flexible but non-elastic and non-stretchable elements, such as ropes, strings or wires, are attached to the moveable elongate actuation members 6 at one end, and connected at the opposite end to an electric manipulation arrangement. The electric manipulation arrangement here comprises a rotatable shaft 62, on to which the manipulation elements are connected. The rotatable shaft is driven by an electric motor 63. Thus, when the electric motor rotates the shaft in one direction, e.g. clockwise, the manipulation elements will be pulled in, thereby moving the corresponding elongate actuation member towards the shaft, and when the electric motor rotates the shaft in the other direction, e.g. counter-clockwise, the manipulation elements will be released, whereby the corresponding elongate actuation member will be moved away from the shaft, due to the force exerted by the elastic element(s).

In the embodiment of FIG. 10*a*, two manipulation elements are connected between each elongate actuation member and the corresponding shaft. However, only one manipulation element may also be used, or more than two, such as three or four.

Even though the shaft and roller are shown as being arranged in the plane of the mattress, and exterior from the short side of the mattress, it is to be appreciated by the skilled artisan that many other placements of the manipulation arrangement are also feasible, such as below the mattress and the like. Further, the manipulation elements need not extend along straight lines, but may be arranged in curved paths, in particular outside the mattress. Sliding surfaces, rollers and the like may be arranged to provide a smoot transition between different extension directions.

In another embodiment, similar to the one discussed in relation to FIG. 10*a*, the manipulation elements 61' are connected at one end to the corresponding elongate actuation member, just as in the previous example, but are then connected together into a single manipulation element 61" at the other end, before being connected to the shaft 62. Hereby, the shaft can be made much shorter and more compact, and may e.g. be formed as a roll, a wheel or the like.

Figure 10B:
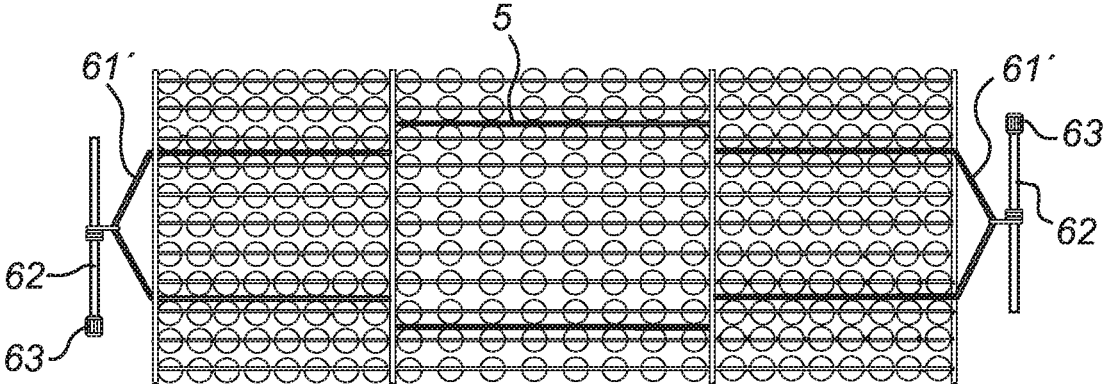

In the embodiments discussed in relation to FIGS. 10*a* and 10*b*, one manipulation arrangement is provided for each elongate actuation member. In the illustrative examples, two elongate actuation members are provided, each being controlled by a corresponding shaft and motor. Thus, one shaft and motor is here provided at each short side of the mattress. This is of advantage in many applications, since it enables independent control of each of the elongate actuation members. However, in many situations, the elongate actuation members are preferably moved simultaneously and in controlled relation to each other. In such embodiments, a single manipulation arrangement may be used for controlling all the elongate actuation members. Such an arrangement provides the advantages of being more compact and more cost-efficient.

Figure 10C:
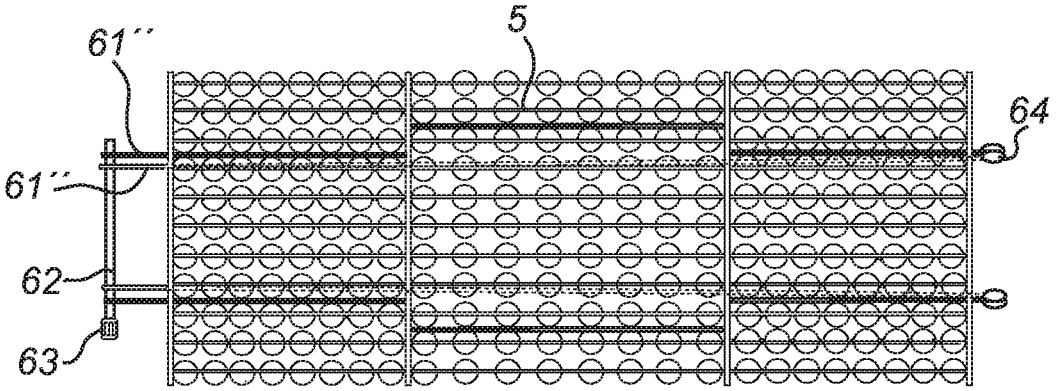

In the embodiment of FIG. 10*c*, a single manipulation arrangement is used for controlling all, here two, elongate actuation members. In this arrangement, a single rotatable shaft 62" is arranged at one side of the mattress, and being operated by a single electric motor 63". The shaft is connected to the elongate actuation member being closest to the shaft by manipulation elements in the same way as in the previously discussed embodiments. Further manipulation elements are connected to the shaft at one end, and then extending in a path beneath or through the mattress to a fixed securement at the other side of the mattress, and further to the other elongate actuation element, being farthest away from the shaft. The fixed securement is preferably realized as a roller 64, a sliding surface, a loop or the like.

In the above-discussed embodiments, the manipulation arrangement comprises a rotatable shaft. However, many other arrangements for effecting pushing and/or pulling of the manipulation elements are feasible.

Figure 11:
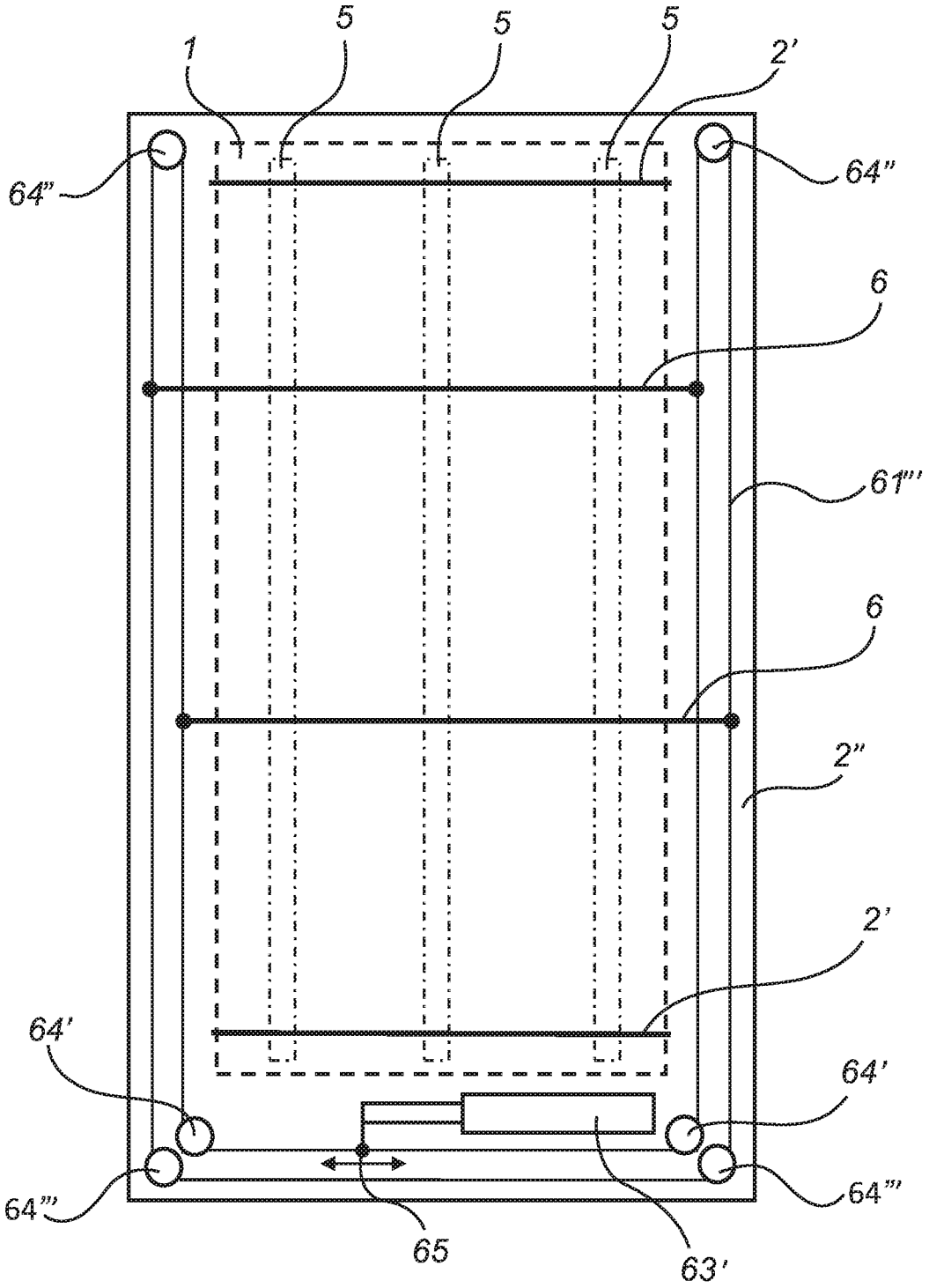
FIG. 11 is a schematic top view of a further embodiment of the present invention.

In yet another embodiment, shown in FIG. 11, the elongate actuation members 6 have an extension that is greater than the width of the mattress 1 (only indicated in dashed lines not to obscure the other details), so that ends of the elongate actuation members extend out from the long sides of the mattress. These extending ends are connected to manipulation element(s) 61''', such as wire(s), that extends along the long sides of the mattress. Further, in this arrangement, the manipulation arrangement comprises a connector 65 to which the manipulation element(s) is connected, and which is moveable by means of a linear actuator, an electric hydraulic piston arrangement or the like. In the illustrative example, a piston 63' is used.

In this embodiment, a single manipulation arrangement is provided for operation of both the elongate actuation members, but again it should be acknowledged that more than one manipulation arrangement may also be used.

In the illustrated manipulation arrangement, the manipulation element(s) 61''' form a closed loop, being made of a single manipulation element, or a plurality of connected manipulation elements. In particular, the manipulation arrangement may comprise a steel wire, and preferably a single steel wire arranged in a closed loop. The manipulation element is connected to the connector 65 being controllably displaceable by the piston 63', here arranged close to one of the short ends of the mattress. The wire extends to one corner of the mattress, and to a roller 64', sliding surface, hook or the like. The wire then continues in parallel with the long side of the mattress past an end of one elongate actuation member 6 to which it is connected, and to a roller 64'' or the like arranged at the opposite corner. The wire then extends back, parallel to the same long side, and past an end of the other elongate actuation member 6, to which it is connected, and to a second roller 64''' or the like, arranged in the first corner. The wire then continues parallel to the short side, and to the opposite corner, and to another roller 64''' or the like, and down along the second long side. Here, the wire first passes the first elongate actuation member 6, to which it is connected, down to the opposite corner, and a roller 64'' or the like, and up towards the first short side again, via an end of the second elongate actuation member 6, to which it is connected. Finally, the wire continues via a roller 64' or the like to the connector 65 again, thereby closing the loop.

Thus, by moving the connector 65 in one direction, such as to the right in the figure, by means of the piston, the wire moves in one direction along the loop, such as clockwise, thereby moving the elongate actuation members 6 simultaneously away from each other. By moving the connector 65 in the other direction, such as to the left in the figure, the wire moves in the other direction along the loop, such as counter-clockwise, thereby moving the elongate actuation members 6 simultaneously towards each other.

As in the previous embodiments, the ends of the mattress 1 are fixed in place. In this embodiment, rods 2', such as steel rods, are arranged at the ends of the mattress, such as between the outermost two rows of spring units, and connected to the frame 2'', such as to the bottom of the frame or one or several side walls of the frame.

Further, elastic elements 5 may be provided for providing a retracting force to parts of the mattress or the entire mattress. In this example, the elastic elements 5 extend over the full length or essentially the full length of the mattress. The elastic elements are here also only indicated with dashed lines, not to obscure the other parts. However, since the elongate actuation members are here actively moved both back and forth, the elastic elements are here primarily used to provide a good distribution of the pocket units within each part and in each state, but the elastic elements may in this embodiment also be omitted.

As the elongate actuation members 6 are moved towards each other, by moving the connector 65 to the right in the figure, the central part of the mattress, between the elongate actuation members, is compressed, whereas the outer parts adjacent the short sides of the mattress 1 are expanded. Hereby, a user will perceive the mattress as being firmer. When the elongate actuation members 6 are moved away from each other, by moving the connector 65 to the left in the figure, the central part of the mattress, between the elongate actuation members, will instead be expanded, whereas the outer parts adjacent the short sides of the mattress 1 are instead compressed. Hereby, the user will instead perceive the mattress as being softer.

In this embodiment, the manipulation elements are arranged outside the mattress, thereby avoiding interference with the springs etc, and also providing a more cost-efficient assembly.

Figure 12:
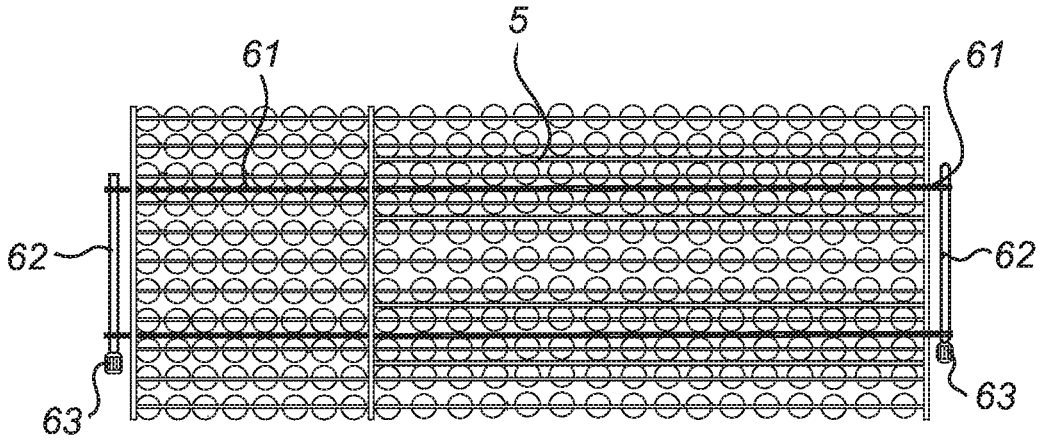
FIG. 12 is a schematic top view of another embodiment of the present invention.

In the previously discussed embodiments, two elongate actuation elements are provided. However, as already mentioned, three or more elongate actuation members may also be used. It is also possible to use only one elongate actuation member. Such an embodiment is illustrated in FIG. 12. Here, an elongate actuation member 6 is provided, preferably being closer to one of the short sides than the other, and being maneuvered e.g. by means of a manipulation arrangement of the type discussed above, in relation to the other embodiments. In the illustrative example, a manipulation arrangement similar to the ones discussed in relation to FIGS. 10*a-b* is shown, but other arrangements, such as the ones of FIGS. 10*c* and 11 may also be used. Here, the elongate actuation members is preferably actively moved both back and forth, thereby making the elastic elements dispensable. However, elastic elements may still be useful to provide a good distribution of the springs, in particular in the larger mattress part.

Figure 13:
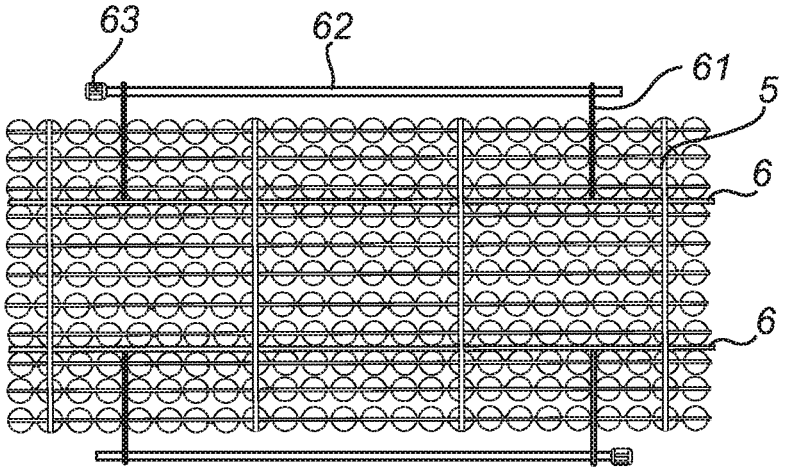
FIG. 13 is a schematic top view of still another embodiment of the present invention.

In all the above-discussed embodiments, the expansion and compacting occurs in a length direction of the mattress. However, it is also possible to provide the expansion and contraction in a width direction. Such an embodiment is illustrated in FIG. 13. Here, the elongate actuation members 61 extend in a length direction of the mattress, instead of in the width direction, as in the previous examples. Furthermore, manipulation elements 61 extend in the width direction, for effecting movement of the elongate actuation members towards the long sides of the mattress and/or towards the center. In the illustrative example, rotatable shafts 62 are arranged along each long side, providing possibilities to pull the elongate actuation members towards the long sides, e.g. by means of an electric motor 63. Further, elastic elements 5 are provided to bring the elongate actuation members back towards each other when released. However, any of the other, above-discussed manipulation arrangements may also be used.

As already mentioned, the adjustable mattress may be arranged in combination with another mattress, such as another pocket spring mattress, a foam mattress, or the like. Further, the adjustable mattress may be combined with one or several padding layers or the like.

Preferably, a low friction surface is arranged on at least one side of the adjustable mattress. Such a low friction surface may be provided by means of a sheet of low friction material, such as polyether sheet. Such a sheet may be provided between the adjustable mattress and another mattress, or on top of the mattress, if no other mattress is provided, or between the adjustable mattress and an overlying padding. The low friction sheet lowers the resistance for adjusting the adjustable mattress. Hereby, less power is required for the adjustment, and also, there is less risk of deformations and the like.

Similarly, if the adjustable mattress rests on a frame plate, the frame plate preferably is made of a material providing a low friction surface. For example, the base plate may be made of reinforced plastic material. Alternatively, a sheet of low friction material, such as a polyether sheet, may be arranged between the base plate and the adjustable mattress.

The person skilled in the art realizes that the present invention by no means is limited to the preferred embodiments described above. On the contrary, many modifications and variations are possible within the scope of the appended claims. For example, the adjustable mattress may be arranged in various combinations with an additional mattress, paddings and sheets. Further, the elastic elements may be arranged over only some parts of the mattress, or in multiple parts, or in all parts, or extending over several or all of the parts. Also, the elastic elements may be arranged in various ways, such as above, underneath and/or between the pocket units. Further, the elongate actuation members may be arranged in various ways, and may be embedded in various ways within the mattress. Still further, the elongate actuation members may be manually adjustable, or be electrically adjustable in various ways. Such obvious variants must be considered to be comprised by the invention as defined by the appended claims.

The invention claimed is:

1. A pocket spring mattress arrangement comprising:

a pocket spring mattress having a plurality of pocketed units of coil springs individually arranged in pockets formed of a casing material, said pocket spring mattress having at least two parts, the at least two parts including at least two compactable parts; and at least one elongate actuation member extending perpendicular to a compacting direction for said at least two compactable parts, said compacting direction corresponding to a width or length direction of the pocket spring mattress, and being embedded within the pocket spring mattress between two of said at least two parts, said at least one elongate actuation member being moveable in the compacting direction to expand or contract one or more of the at least two compactable parts of the pocket spring mattress; wherein the pocket spring mattress has fixed outer dimensions, and said at least one elongate actuation member is configured to contract one of said at least two compactable parts while simultaneously expanding the other of said at least two compactable parts.

2. The pocket spring mattress arrangement of claim 1, wherein the plurality of pocketed units comprise:

a plurality of parallel continuous strings interconnected side by side, each of the plurality of parallel continuous strings being formed of a continuous casing material, enclosing a plurality of coil springs in individual pockets, forming a line of integrated pocketed units.

3. The pocket spring mattress arrangement of claim 2, wherein the plurality of parallel continuous strings extend in the compacting direction.

4. The pocket spring mattress arrangement of claim 1, further comprising:

at least one elastic element configured to provide a contraction force to contract the one or more of the at least two compactable parts of the pocket spring mattress in the compacting direction.

5. The pocket spring mattress arrangement of claim 4, wherein the at least one elastic element extends between a first end and a second end in an extension direction, said extension direction corresponding to at least one of the width or length direction of the pocket spring mattress, and said at least one elastic element is configured to provide a contraction force to bring said first end and said second end towards each other, thereby providing the contraction force to contract the one or more of the at least two compactible parts of the pocket spring mattress extending between said first end and said second end in the extension direction.

6. The pocket spring mattress arrangement of claim 4, wherein at least one of the at least one elastic element is arranged above or underneath a line of pocketed units, and connected to at least one end surface of said plurality of pocketed units.

7. The pocket spring mattress arrangement of claim 4, wherein at least one of the at least one elastic element is arranged between lines of pocketed units, and connected to longitudinal surfaces of at least one of said pocketed units.

8. The pocket spring mattress arrangement of claim 1, further comprising:

at least two elongate actuation members, extending perpendicular to said compacting direction at a distance from each other.

9. The pocket spring mattress arrangement of claim 1, wherein the at least one elongate actuation member includes a relatively rigid rod or plate.

10. The pocket spring mattress arrangement of claim 1, wherein the at least one elongate actuation member extends over at least 50% of the length of the width or length of the pocket spring mattress.

11. The pocket spring mattress arrangement of claim 1, wherein the at least one elongate actuation member extends between rows of pocketed units.

12. The pocket spring mattress arrangement of claim 1, further comprising:

at least one manipulation element, extending in the compacting direction, and connected to said at least one elongate actuation member, for controlled movement of the at least one elongate actuation member in the compacting direction.

13. The pocket spring mattress arrangement of claim 12, further comprising:

an electric actuator for controlled pulling of the at least one manipulation element.

14. A method for adaptation of firmness of a mattress arrangement, the method comprising:

providing a pocket spring mattress, said pocket spring mattress having fixed outer dimensions and at least two parts, the at least two parts including at least two compactable parts;

providing at least one elongate actuation member extending perpendicular to a compacting direction for said at least two compactable parts, said compacting direction corresponding to a width or length direction of the pocket spring mattress, and being embedded within the pocket spring mattress between two of said at least two parts, said at least one elongate actuation member being moveable in the compacting direction; and controlling movement of the at least one elongate actuation member to contract one of the at least two compactable parts and simultaneously expand the other of the at least two compactible parts.

15. The pocket spring mattress arrangement of claim 5, wherein at least one of the at least one elastic element is arranged above or underneath a line of pocketed units, and connected to at least one end surface of said pocketed units.

16. The pocket spring mattress arrangement of claim 5, wherein at least one of the at least one elastic element is arranged between lines of pocketed units, and connected to longitudinal surfaces of at least one of said pocketed units.

17. The pocket spring mattress arrangement of claim 10, wherein the at least one elongate actuation member extends over at least 70% of the length of the width or length of the pocket spring mattress.

18. The pocket spring mattress arrangement of claim 16, wherein the at least one elongate actuation member extends over at least 90% of the length of the width or length of the pocket spring mattress.

* * * * *